US007726870B1

(12) United States Patent
Lott

(10) Patent No.: US 7,726,870 B1
(45) Date of Patent: Jun. 1, 2010

(54) METHOD FOR MIXING FLUIDS WITH AN EDUCTOR

(75) Inventor: William Gerald Lott, Houston, TX (US)

(73) Assignee: Vortex Systems (International) CI, Grand Cayman (KY)

( * ) Notice: Subject to any disclaimer, the term of this patent is extended or adjusted under 35 U.S.C. 154(b) by 0 days.

(21) Appl. No.: 12/487,044

(22) Filed: Jun. 18, 2009

Related U.S. Application Data

(63) Continuation-in-part of application No. 12/176,540, filed on Jul. 21, 2008, now Pat. No. 7,618,182, which is a continuation-in-part of application No. 11/737,690, filed on Apr. 19, 2007, now Pat. No. 7,401,973.

(51) Int. Cl.
*B01F 13/02* (2006.01)

(52) U.S. Cl. ..... 366/107; 366/173.1; 366/173.2; 366/191

(58) Field of Classification Search ..... 366/167.1, 366/173.1, 173.2, 163.1, 163.2, 101, 107, 366/165.5, 165.1, 181.6, 182.1, 182.2, 191, 366/177.1, 159.1, 136, 137
See application file for complete search history.

(56) References Cited

U.S. PATENT DOCUMENTS

| | | | | | |
|---|---|---|---|---|---|
| 981,098 | A | * | 1/1911 | McCaskell | 422/224 |
| 1,196,595 | A | * | 8/1916 | Sharpe | 423/435 |
| 1,706,418 | A | * | 3/1929 | Sissom | 366/165.4 |
| 1,878,825 | A | * | 9/1932 | Charles | 68/184 |
| 1,992,261 | A | * | 2/1935 | Traudt | 68/235 R |
| 2,509,288 | A | * | 5/1950 | Brochner | 366/160.2 |
| 2,751,335 | A | * | 6/1956 | Carver et al. | 208/203 |
| 3,233,874 | A | * | 2/1966 | Betulius | 366/167.1 |
| 3,425,669 | A | * | 2/1969 | Gaddis | 366/153.1 |
| 3,565,404 | A | * | 2/1971 | Reid et al. | 366/137 |
| 3,586,294 | A | * | 6/1971 | Strong | 366/163.2 |
| 3,782,695 | A | * | 1/1974 | Sandiford | 366/163.1 |
| 4,527,716 | A | | 7/1985 | Haas et al. | |
| 4,764,283 | A | * | 8/1988 | Ashbrook et al. | 210/695 |
| 4,781,467 | A | * | 11/1988 | Williams | 366/138 |
| 4,812,045 | A | * | 3/1989 | Rivers | 366/107 |
| 4,884,500 | A | * | 12/1989 | Iwasaki et al. | 99/517 |
| 5,020,858 | A | | 6/1991 | Nishikawa | |
| 5,211,475 | A | * | 5/1993 | McDermott | 366/137 |
| 5,300,232 | A | * | 4/1994 | Barrington et al. | 210/742 |
| 5,382,411 | A | | 1/1995 | Allen | |
| 5,417,550 | A | * | 5/1995 | Kasai et al. | 417/151 |
| 5,447,394 | A | | 9/1995 | Shepard | |
| 5,470,459 | A | * | 11/1995 | Barrington et al. | 210/149 |

(Continued)

FOREIGN PATENT DOCUMENTS

| | | |
|---|---|---|
| GB | 2123789 | 2/1984 |

*Primary Examiner*—Tony G Soohoo
(74) *Attorney, Agent, or Firm*—Buskop Law Group, PC; Wendy Buskop

(57) ABSTRACT

The invention relates to a method for mixing a static fluid with another component, such as a particulate material, a liquid, a compressible liquid or gas, or combinations thereof, using a motive fluid stream, producing a low pressure region within the static fluid using radial eductors in a tank. The invention further relates to a method for separating oil form an oil and water mixture using a motive fluid stream and air, producing a low pressure region in a tank with entrained air bubbles, wherein the oil attaches to the air bubbles and rises to the surface.

19 Claims, 7 Drawing Sheets

U.S. PATENT DOCUMENTS 5,507,237 A 4/1996 Barrow et al.
5,518,700 A * 5/1996 Ayoub et al. ..... 422/225
5,642,939 A 7/1997 Comardo
5,664,733 A 9/1997 Lott
5,722,552 A 3/1998 Olson
5,735,600 A * 4/1998 Wyness et al. ..... 366/101
5,810,473 A * 9/1998 Manabe et al. ..... 366/132
6,024,874 A 2/2000 Lott
6,109,778 A * 8/2000 Wilmer ..... 366/137
6,200,014 B1 * 3/2001 Babenko ..... 366/167.1
6,217,207 B1 * 4/2001 Streich et al. ..... 366/137
6,223,903 B1 5/2001 Mansouri
6,357,906 B1 * 3/2002 Baudoin et al. ..... 366/163.2
6,488,402 B1 * 12/2002 King et al. ..... 366/173.2
6,585,854 B2 * 7/2003 Scherzinger et al. ..... 162/55
6,796,704 B1 9/2004 Lott
6,821,011 B1 * 11/2004 Crump ..... 366/137
7,025,492 B2 * 4/2006 Dorsch et al. ..... 366/165.1
7,048,432 B2 * 5/2006 Phillippi et al. ..... 366/164.1
7,401,973 B1 7/2008 Lott
2002/0057625 A1 * 5/2002 Russell et al. ..... 366/136
2004/0081015 A1 * 4/2004 Graham, Sr. ..... 366/173.1
2005/0058020 A1 3/2005 Lott
2005/0111298 A1 5/2005 Lott
2006/0245295 A1 * 11/2006 Dorsch et al. ..... 366/165.1

* cited by examiner

METHOD FOR MIXING FLUIDS WITH AN EDUCTOR

CROSS REFERENCE TO RELATED APPLICATIONS

This application is a Continuation in Part Application of Co-pending U.S. patent application Ser. No. 12/176,540 filed on Jul. 21, 2008, entitled "Dust-Free Low Pressure Mixing System with a Jet Ring Adapter", which claims priority to Ser. No. 11/737,690, filed on Apr. 19, 2007, entitled "Dust-Free Low Pressure Mixing System". Application Ser. No. 11/737,690 has issued as U.S. Pat. No. 7,401,973 on Jul. 22, 2008. These Applications are hereby incorporated in their entirety, the disclosures of which are incorporated herein by reference.

FIELD

The present embodiments generally relate to a method for mixing fluids, liquids, and gases using a high velocity motive fluid stream and forming a low pressure region within the fluid using a principal known as the Bernoulli principle in an eductor.

BACKGROUND

A need exists for a fast low pressure, safe method for mixing powders, particulate, compressible gas, or liquids into a fluid in a confined area that uses a high velocity motive fluid stream to form a low pressure region in the fluid using Bernoulli's principal.

A need also exists for a method to separate oil from water that is low pressure, high velocity, and very efficient.

The present embodiments meet these needs.

BRIEF DESCRIPTION OF THE DRAWINGS

The detailed description will be better understood in conjunction with the accompanying drawings as follows.

Figure 1:
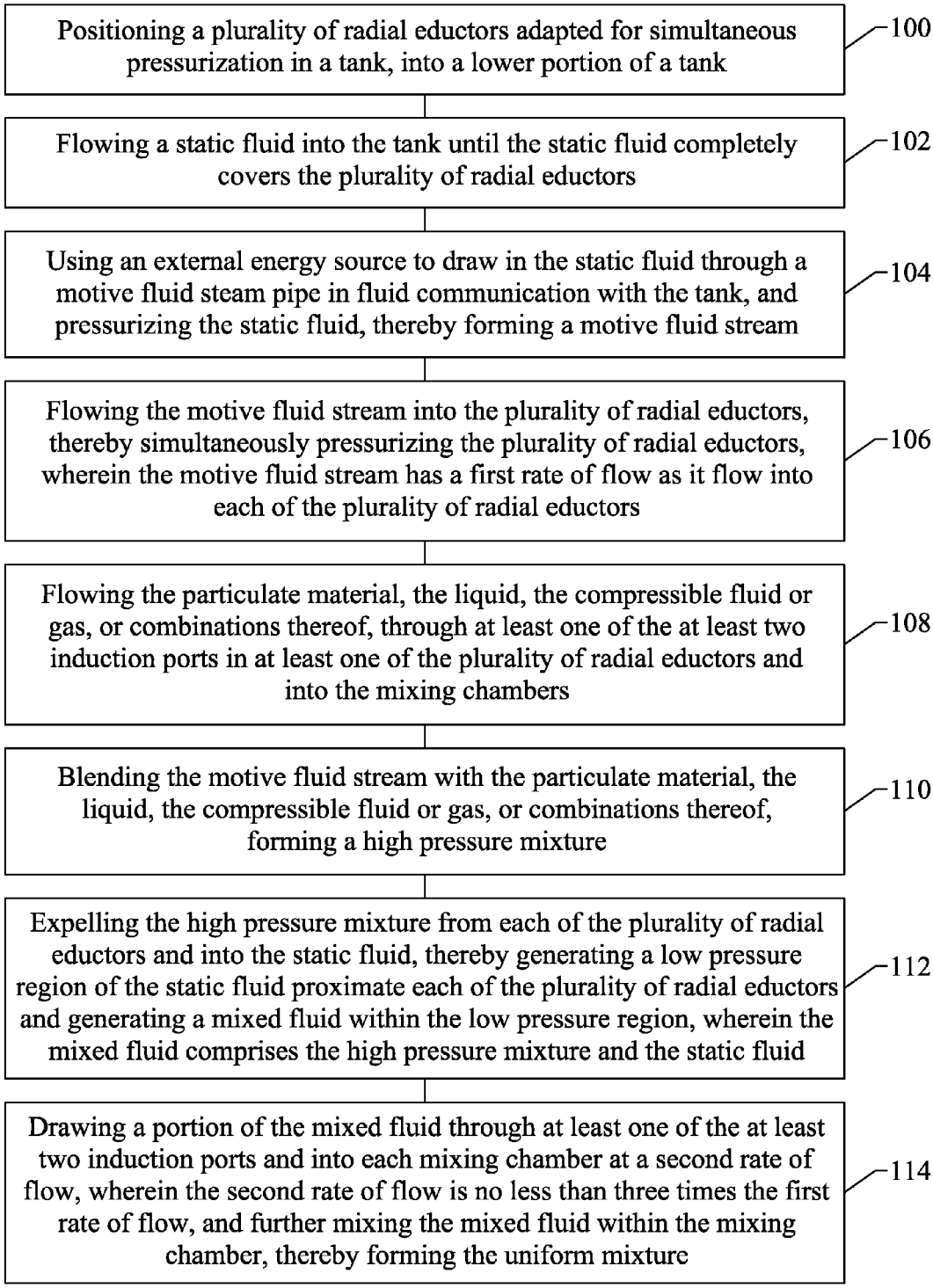
FIG. 1 is a flow diagram of the steps usable to perform an embodiment of the present method.

The present embodiments are detailed below with reference to the listed Figures.

DETAILED DESCRIPTION OF THE EMBODIMENTS

Before explaining the present method in detail, it is to be understood that the method is not limited to the particular embodiments described and that it can be practiced or carried out in various ways.

The embodiments relate to a method for using a motive fluid stream to generate a low pressure region to mix particulate material, a liquid, a compressible fluid or gas, or combinations thereof, as well as to separate oil from an oil and water mixture.

The embodiments further relate to a method for mixing a static fluid with a particulate material, a liquid, a compressible fluid or gas, or combinations thereof, using a motive fluid stream, in order to form a uniform mixture.

The first step can involve positioning a plurality of radial eductors adapted for simultaneous pressurization in a tank, into a lower portion of the tank, such that the radial eductors can create a continuous turbulence within any fluid in the tank.

The second step can involve flowing a static fluid into the tank until the static fluid completely covers the plurality of radial eductors.

The third step can involve simultaneously pressurizing the plurality of radial eductors using an external energy source. The external energy source can draw in the static fluid through a motive fluid stream pipe and pressurize the static fluid, thereby forming a motive fluid stream. The motive fluid stream can then flow into the radial eductors with a first rate of flow, thereby pressurizing the plurality of radial eductors. The motive fluid stream can the exit the radial eductors and flow back into the tank.

The fourth step can involve flowing a particulate material, a liquid, a compressible fluid or gas, or combinations thereof through induction ports in at least one of the plurality of radial eductors and into mixing chambers of the radial eductors.

The fifth step can involve blending the motive fluid stream with the particulate material, the liquid, the compressible fluid or gas, or combinations thereof, to form a high pressure mixture.

The sixth step can include expelling the high pressure mixture, which can be at pressures ranging from 30 psi to 150 psi, from each radial eductor and into the static fluid, thereby generating a mixed fluid in a low pressure region of the static fluid proximate each radial eductor.

The seventh step can involve drawing a portion of the mixed fluid through at least one of the induction ports into each mixing chamber at a second rate of flow, wherein the second rate of flow is no less than three times the first rate of flow.

The following is in part a description of an embodiment of an apparatus usable in the present method. The present method is not limited to the following described apparatus and can be practiced in various ways and with various apparatus.

The particulate material usable in the present method can be: a powder such as barium sulfate, barite, bentonite; a granular material such as sand; a polymer such as powdered polymers, such as carboxymethyl cellulose; a powdered cellulose; or another powder.

The liquid usable in the present method can be a slurry, water, gasoline, or another liquid. The percent of particulate material and the liquid, when mixed together, can have a weight percent of solids ranging between about 25 weight percent and about 35 weight percent, and a weight percent of liquids ranging between about 65 weight percent to about 75 weight percent.

The static fluid usable in the present method can be a liquid, a solution, a slurry with suspended solids, an admixture, two or more unblended fluids, a drilling fluid, an industrial mixture, municipal waste, a drilling mud, another mixture, or an oil and water mixture that can require separation.

The oil and water mixture can be a sludge of crude oil, water and solids.

The compressible gas can be a gas, such as nitrogen or air.

The uniform mixture formable in the present method can be a surfactant in water, such as an industrial cleaning fluid, a corrosion inhibitor in a fluid, or a number of other mixtures.

In an embodiment of the present method, a plurality of radial eductors are placed into the tank. Each of the radial eductors can have a mixing chamber and at least two induction ports.

The radial eductors can be removably connected to a manifold by means of a threaded or other removable connection. The radial eductors can each connect to the manifold through a plurality of secondary conduits disposed on the manifold.

The manifold can be disposed within the tank, and can be in fluid communication with an external energy source through a central conduit, wherein the central conduit can be a pipe or other similar conduit device. The central conduit can pass into the tank through a bottom port, a top port, or a side port, wherein each port is disposed along the outside surface of the tank. The central conduit can be connected to the tank at an angle relative to a first plane of the tank.

The external energy source usable in the present method can be a centrifugal pump, a progressive cavity pump, a rotary pump, or another type of pump. The external energy source can be in fluid communication with the tank through a motive fluid stream pipe on one end of the external energy source. The external energy source can be in fluid communication with the central conduit, the central conduit can be in fluid communication with the manifold. The manifold, which can be disposed in the tank, can be in fluid communication with the secondary conduits disposed on the manifold. Each of the secondary conduits can be in fluid communication with one of the plurality of radial eductors.

The static fluid can be introduced into the tank until the static fluid completely covers the plurality of radial eductors.

The external energy source can draw the static fluid through the motive fluid stream pipe and pressurize the static fluid, thereby forming the motive fluid stream. The motive fluid stream can flow through the central conduit, through the manifold, through the secondary ports, and into the mixing chambers of the radial eductors. As the motive fluid stream flows into the mixing chambers, it can pass through nozzles disposed within each radial eductor and thereby pressurizes the plurality of radial eductors.

The nozzles can have orifices leading into the mixing chambers. The exterior dimensions of the nozzles can be so sized and constructed as to removably fit within the radial eductors. The nozzle can be hollow to allow fluid to flow through it. The nozzle can be provided with an initially uniform outer diameter converging to a reduced diameter end. An orifice can be provided at the reduced diameter end of the nozzle, such as a "lobestar" nozzle, herein referred to as a symmetric nozzle, or the "lobestar" nozzle made by Vortex Ventures, Inc. of Houston, Tex. It can be contemplated that other orifices can be used as well.

The motive fluid stream, which can be pressurized by the external energy source, is transformed into a high velocity stream as it passes through the nozzle. The motive fluid stream can be pressurized to between about 30 psi to about 150 psi, and can have between about 69 feet to about 346 feet of head, and can have a first flow rate.

The mixing chambers usable in the present method can have diverging walls, converging walls, and constant-diameter walls.

The induction ports can be radially spaced around the diverging walls. The induction ports can also be positioned parallel to the nozzle. The induction ports can extend from the exterior of the radial eductor and into the mixing chamber.

The induction ports can extend angularly through the diverging wall at an angle to a central axis of each induction ports defining an acute angle with the central axis of the radial eductor. The induction ports can be helically shaped induction ports.

The particulate material, the liquid, the compressible fluid or gas, or combinations thereof, can flow through at least one of the at least two induction ports and into the mixing chamber of at least one of the plurality of radial eductors.

The motive fluid stream can then be blended with the particulate material, the liquid, the compressible fluid or gas, or combinations thereof within the mixing chamber, thereby forming a high pressure mixture. Pressure fluctuations and intense turbulence occurs within the mixing chamber and provides highly efficient mixing within a small space.

The high pressure mixture can then be expelled from each of the plurality of radial eductors and into the static fluid within the tank, thereby generating a mixed fluid in a low pressure region proximate to each of the plurality of radial eductors, wherein the mixed fluid comprises the static fluid mixed with the high pressure mixture. The low pressure region can be a few inches from the induction ports.

The interior area of the mixing chamber that is defined by the diverging walls can comprise a diffuser which ejects the high pressure mixture into the tank thereby creating the mixed fluid.

The mixed fluid can then flow into the mixing chambers of the radial eductors through induction ports at a second flow rate, and can be further mixed in the mixing chamber and expelled from the radial eductors, thereby forming a uniform mixture. The second flow rate can be no less than three times the first flow rate.

It can be contemplated that the static fluid can continuously flow through the into the external energy source to be pressurized.

The nozzle can allow the high pressure mixture, having a pressure of about 50 psi that relates to about 76 feet per second, to exit the radial eductors, and simultaneously, have a second rate of flow of the mixed fluid entering the radial eductors through induction ports to the mixing chambers.

Additionally, the motive fluid stream issuing from a nozzle facilitates the flow of static fluid into the tank in a current like rotation.

In an embodiment, the induction ports can be other than a straight conduit to the mixing chamber, in order to allow the mixed fluid to flow into the mixing chamber at a flow that is greater than laminar flow.

The radial eductors can be positioned to create a continuous turbulence or current within the tank. For example, the radial eductors can be positioned geometrically opposing each other so that the expelled high pressure mixture flows from each radial eductor in the same direction, thereby creating a continuous turbulence in the tank, allowing the expelled high pressure mixture to push the static fluid and/or the mixed fluid against the induction ports, thereby drawing the static fluid and/or the mixed fluid into the mixing chamber of the radial eductors.

The radial eductors can be connected through a common conduit. In operation the radial eductors can be monitored from a remote source, including being viewable from another location, to provide highly controlled mixing of the static fluid with the other components in the mixing chamber.

Each of the radial eductors can be adapted for simultaneous pressurization in the tank.

It can be contemplated that the apparatus usable in the present method can have four radial eductors, however other numbers of radial eductors can also be used.

The tank usable in the present method can have a shape such as: rectangular, circular square, or any other geometrical shape. The tank can have at least one wall, a bottom, and a top. The tank bottom can be flat, dish shaped, parabolic, cone shaped, or any other shape. The tank can be adapted to contain between about 100 gallons to about 250,000 gallons of a fluid.

In an alternate embodiment of the present method, a vapor pipe can be disposed above the surface of the static fluid for capturing vapors. The vapor pipe can be in fluid communication with at least one mixing chamber of the radial eductors through at least one of the at least two induction ports, thereby introducing the vapors into the mixing chamber for mixing with the other contents of the mixing chamber. It can be contemplated that the vapor pipe can be used in various embodiments usable in the present method.

A vent pipe can be provided for in any of the embodiments of apparatus that are usable in the present method. The vent pipe can provide a vent for gases and vapor to exit the interior of the tank.

The vapor can be a volatile organic compound from gasoline or any other vapor.

An alternate embodiment of the present method involves a method for separating oil from water in an oil and water mixture.

The first step can include positioning a plurality of radial eductors in a tank. Each radial eductor usable in this method can have a mixing chamber and at least two induction ports.

The radial eductors usable in this method can be in fluid communication with an external energy source. The external energy source can further be in fluid communication with the tank through a motive fluid stream pipe. The radial eductors can be positioned to create a continuous turbulence in the tank, facilitating mixing.

The second step can involve flowing an oil and water mixture into the tank until the oil and water mixture completely covers the plurality of radial eductors, thereby creating a liquid surface.

The third step can involve drawing in the oil and water mixture into the external energy source through the motive fluid stream pipe and pressurizing the oil and water mixture, thereby forming a motive fluid stream. The external energy source can the be used to flow the motive fluid stream into the plurality of radial eductors thereby simultaneously pressurizing the plurality of radial eductors. The motive fluid stream can have a first flow rate as it enters the plurality of radial eductors, and can then be expelled from the plurality of radial eductors and into the oil and water mixture, thereby creating a low pressure oil and water mixture proximate each radial eductor.

The fourth step can involve aspirating or pressurizing air through a first induction port in at least one of the plurality of the radial eductors and into the mixing chamber, while simultaneously drawing some of the low pressure oil and water mixture through at least one induction port and into the mixing chamber of each radial eductor.

The fifth step can include blending the motive fluid stream and the low pressure oil and water mixture with the aspirated or pressurized air within each radial eductor, thereby forming a high pressure mixture with entrained air bubbles.

The sixth step can involve expelling the high pressure mixture with entrained air bubbles from each radial eductor and into the oil and water mixture. Oil is thereby enabled to separate from water, attach to the air bubbles, and rise to the liquid surface for removal from the water.

It can be contemplated that the oil and water mixture can continuously flow into the external energy source and be pressurized forming a continuous motive fluid stream.

The apparatus usable in the present embodiment of the method can comprise a motive fluid stream pipe, a motive fluid stream, an external energy source, a central conduit, a plurality of secondary conduits, a bottom port, a top port, a side port, a tank, a manifold, and a plurality of eductors substantially as described above with respect to other embodiments.

The present embodiment of an apparatus usable in the present method for separating oil from water in an oil and water mixture can further comprise an air source which can be in fluid communication with at least one of the at least two induction ports through an air pipe. Air can therefore flow from the air source, through the air pipe and into at least one mixing chambers of at least one radial eductor.

In the present embodiment, the static fluid can comprise an oil and water mixture and can be introduced into the tank until it completely covers the plurality of radial eductors, thereby forming a liquid surface.

The external energy source draws in the oil and water mixture through the motive fluid stream pipe and pressurizes the oil and water mixture, thereby forming the motive fluid stream. The motive fluid stream then flows into the mixing chambers substantially as described above, and is expelled from the mixing chambers, forming a low pressure oil and water mixture proximate the radial eductors.

Air can then be aspirated or pressurized through one of the at least two induction ports and flow into at least one of the mixing chambers of the radial eductors. Simultaneously, the low pressure oil and water mixture can be introduced into the mixing chambers through at least one of the at least two induction ports. The air can be introduced into the oil and water mixture using a pressure between 40 and 150 psi.

The motive fluid stream can then be mixed with the aspirated or pressurized air and the low pressure oil and water mixture, thereby forming a high pressure mixture with entrained air bubbles.

The high pressure mixture with entrained air bubbles can then be expelled from each of the plurality of radial eductors and into the oil and water mixture, thereby enabling the oil to attach to the entrained air bubbles within the high pressure mixture, and to rise to the liquid surface, for removal from the oil and water mixture.

The low pressure oil and water mixture can have a viscosity ranging between the viscosity of water and the viscosity of slurries of up to about 1200 centipoises.

The radial eductors usable in the present method operate in accordance with the phenomenon observed in hydrodynamics, wherein the pressure in a stream of fluid decreases as the velocity increases, which is an operation of the Bernoulli principle.

Turning now to FIG. 1, the steps of an embodiment of the current method are depicted.

Step 100 involves positioning a plurality of radial eductors adapted for simultaneous pressurization in a tank, into a lower portion of a tank.

The radial eductors are positioned to create a continuous turbulence in the tank. Each radial eductor can have a mixing chamber and at least two induction ports.

Step 102 involves flowing a static fluid into the tank until the static fluid completely covers the plurality of radial eductors.

Step 104 involves using an external energy source to draw in the static fluid through a motive fluid steam pipe in fluid communication with the tank, and pressurizing the static fluid, thereby forming a motive fluid stream.

Step 106 involves flowing the motive fluid stream into the plurality of radial eductors, thereby simultaneously pressurizing the plurality of radial eductors, wherein the motive fluid stream has a first rate of flow as it flow into each of the plurality of radial eductors.

Step 108 involves flowing the particulate material, the liquid, the compressible fluid or gas, or combinations thereof, through at least one of the at least two induction ports in at least one of the plurality of radial eductors and into the mixing chambers.

Step 110 involves blending the motive fluid stream with the particulate material, the liquid, the compressible fluid or gas, or combinations thereof, forming a high pressure mixture.

Step 112 involves expelling the high pressure mixture, which can be at pressures ranging from about 30 psi to about 150 psi, from each of the plurality of radial eductors and into the static fluid, thereby generating a low pressure region of the static fluid proximate each of the plurality of radial eductors and generating a mixed fluid within the low pressure region, wherein the mixed fluid comprises the high pressure mixture and the static fluid.

Step 114 involves drawing a portion of the mixed fluid through at least one of the at least two induction ports and into each mixing chamber at a second rate of flow, wherein the second rate of flow is no less than three times the first rate of flow, and further mixing the mixed fluid within the mixing chamber, thereby forming the uniform mixture.

Figure 2:
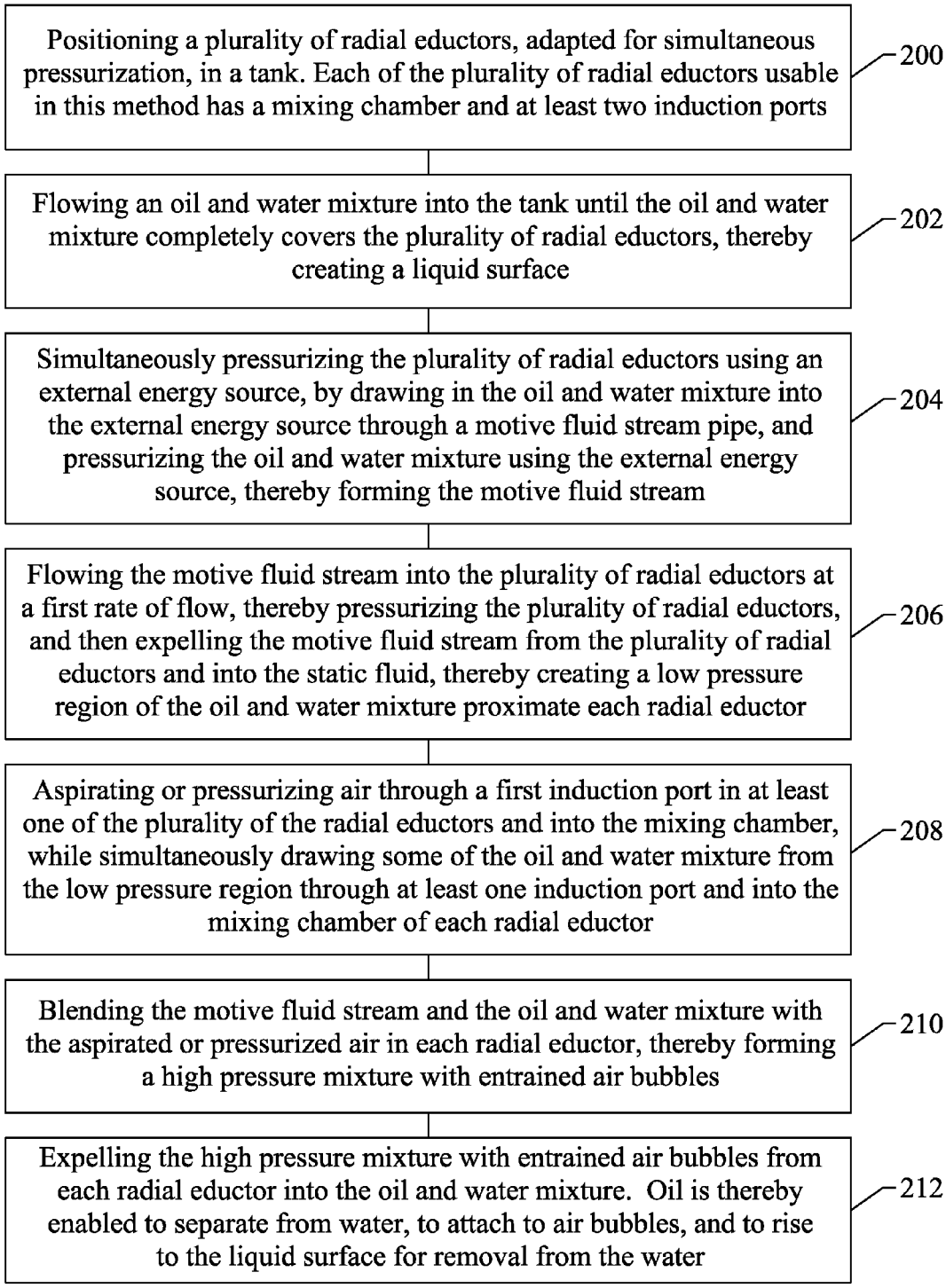
FIG. 2 is a flow diagram of the steps usable to perform an alternate embodiment of the present method.

FIG. 2 is a flow diagram depicting embodiment of the method usable for separating oil from water in an oil and water mixture.

Step 200 depicts the step of positioning a plurality of radial eductors, adapted for simultaneous pressurization, in a tank. Each of the plurality of radial eductors usable in this method has a mixing chamber and at least two induction ports.

The radial eductor usable in this method is connected to an external energy source which pressurizes the static fluid to allow for simultaneous pressurization of all radial eductors in the tank. The radial eductors are positioned to create a continuous turbulence in the tank, facilitating mixing.

Step 202 involves flowing an oil and water mixture into the tank until the oil and water mixture completely covers the plurality of radial eductors, thereby creating a liquid surface.

Step 204 involves simultaneously pressurizing the plurality of radial eductors using an external energy source, by drawing in the oil and water mixture into the external energy source through a motive fluid stream pipe, and pressurizing the oil and water mixture using the external energy source, thereby forming the motive fluid stream.

Step 206 involves flowing the motive fluid stream into the plurality of radial eductors at a first rate of flow, thereby pressurizing the plurality of radial eductors, and then expelling the motive fluid stream from the plurality of radial eductors and into the static fluid, thereby creating a low pressure region of the oil and water mixture proximate each radial eductor.

Step 208 involves aspirating or pressurizing air through a first induction port in at least one of the plurality of the radial eductors and into the mixing chamber, while simultaneously drawing some of the oil and water mixture from the low pressure region through at least one induction port and into the mixing chamber of each radial eductor.

Step 210 includes blending the motive fluid stream and the oil and water mixture with the aspirated or pressurized air in each radial eductor, thereby forming a high pressure mixture with entrained air bubbles.

Step 212 involves expelling the high pressure mixture with entrained air bubbles from each radial eductor into the oil and water mixture. Oil is thereby enabled to separate from water, to attach to air bubbles, and to rise to the liquid surface for removal from the water.

Figure 3:
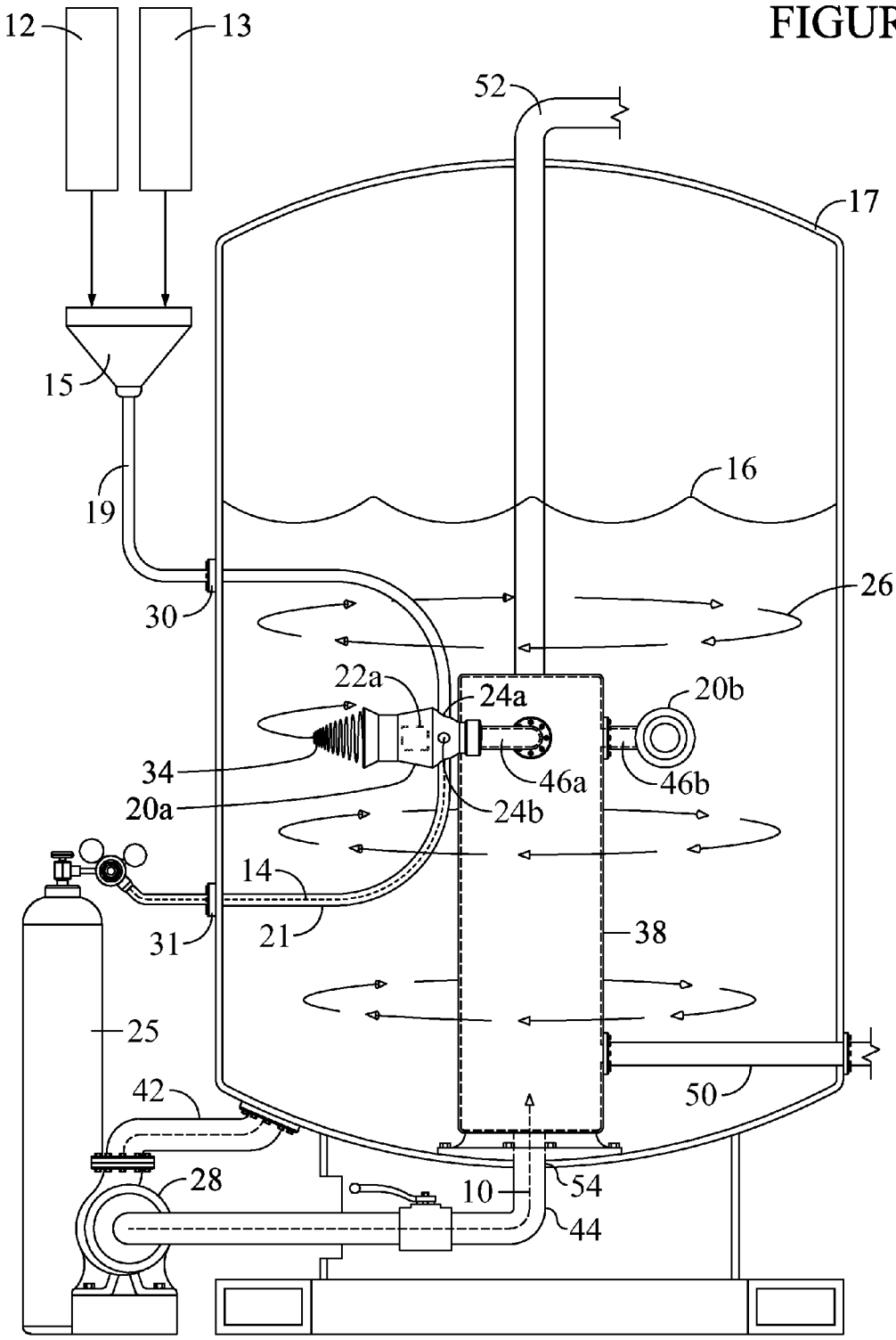
FIG. 3 depicts an apparatus usable to perform present method.

FIG. 3 depicts an apparatus usable for performing the embodiment of the method as described in FIG. 1.

A tank 17 is depicted having a manifold 38 disposed within the tank 17. The manifold 38 is in fluid communication with an external energy source 28 through a central conduit 44. The central conduit 44 is depicted disposed through a bottom port 54 of the tank 17. Alternatively, the external energy source 28 can communicate through the tank 17 through a side port 50 or a top port 52. Side port 50, top port 52, and bottom port 54 are contemplated to be usable in a variety of embodiments of apparatus usable in the present method.

A static fluid 16 is disposed within the tank 17. Static fluid 16 can be introduced into the tank 17 through side port 50 or top port 52.

A plurality of radial eductors 20*a* and 20*b* are disposed in fluid communication with the manifold 38 through secondary conduits 46*a* and 46*b*.

Each of the plurality of radial eductors 20*a* and 20*b* has a mixing chamber, mixing chamber 22*a* is shown disposed within radial eductor 20*a*. Each of the plurality of radial eductors 20*a* and 20*b* further has at least two induction ports, induction ports 24*a* and 24*b* are depicted disposed on radial eductor 20*a*. Each of the at least two induction ports is in fluid communication with the mixing chambers. The plurality of radial eductors 20*a* and 20*b* are adapted for simultaneous pressurization by external energy source 28.

A motive fluid stream pipe 42 is depicted in fluid communication with the external energy source 28 and the tank 17. Motive fluid stream pipe 42 can draw in the static fluid 16 from the tank 17 and flow the static fluid 16 into the external energy source 28. External energy source 28 can pressurize the static fluid 16 thereby forming a motive fluid stream 10. The motive fluid stream 10 can have a first flow rate, and is depicted flowing from the external energy source 28 and through the central conduit 44 into the manifold 38. The motive fluid stream 10 further flows through the secondary conduits 46*a* and 46*b* and into the mixing chambers of the plurality of radial eductors. The external energy source 28 pressurizes the static fluid 16 in order to produce the motive fluid stream 10 and thereby pressurize the plurality of radial eductors.

Particulate material 12 and liquid 13 are depicted flowing through a hopper 15. the particulate material 12 and the liquid 13 are at least partially blended within the hopper 15. Hopper 15 has hopper conduit 19 which is in fluid communication with one of the plurality of radial eductors, here shown to be radial eductor 20*a*, through one of the at least two induction ports 24*a*. Particulate material 12 and liquid 13 can therefore flow through hopper 15, hopper conduit 19, one of the at least two induction ports 24*a* and 24*b*, and into the mixing chamber 22*a*. Hopper conduit 19 is in communication with tank 17 through first inlet port 30.

A compressible fluid or gas 14 can be introduced to the plurality of radial eductors 20*a* and 20*b* from a fluid or gas source 25 which can be in fluid communication with one of the at least two induction ports 24*a* and 24*b* through a fluid or gas conduit 21. Fluid or gas conduit 21 can be in communication with the tank 17 through a second inlet port 31.

Static fluid 16 is depicted within the tank 17 at a level that completely covers the plurality of radial eductors 20*a* and 20*b*.

The particular material 12, the liquid 13, the compressible fluid or gas 14, or combinations thereof are then blended in the mixing chamber 22*a* with the motive fluid stream 10, thereby forming a high pressure mixture 34 which is depicted being expelled from one of the plurality of radial eductors 20*a* and into the static fluid 16. A continuous turbulence 26 is depicted, which is formed in the static fluid by the plurality of radial eductors 20*a* and 20*b*.

The particulate material 12, the liquid 13, and the compressible fluid or gas 14 are then blended within the static fluid 16 in the tank 17 to form a mixed fluid, not shown.

The tank 17 depicts the mixed fluid having continuous turbulence 26 thereby creating a flow within the tank 17.

The mixed fluid, not shown, can be further drawn into one of the at least two induction ports 24*a* and 24*b* to further mix within the mixing chambers at a second flow rate, thereby forming a uniform mixture.

Throughout the mixing, the contents of the tank 17 can continuously flow into the external energy source 28 through the motive fluid stream pipe 42 and back into the tank 17 as described above, thereby creating a continuous and thorough mixing of the contents of the tank 17.

Figure 4:
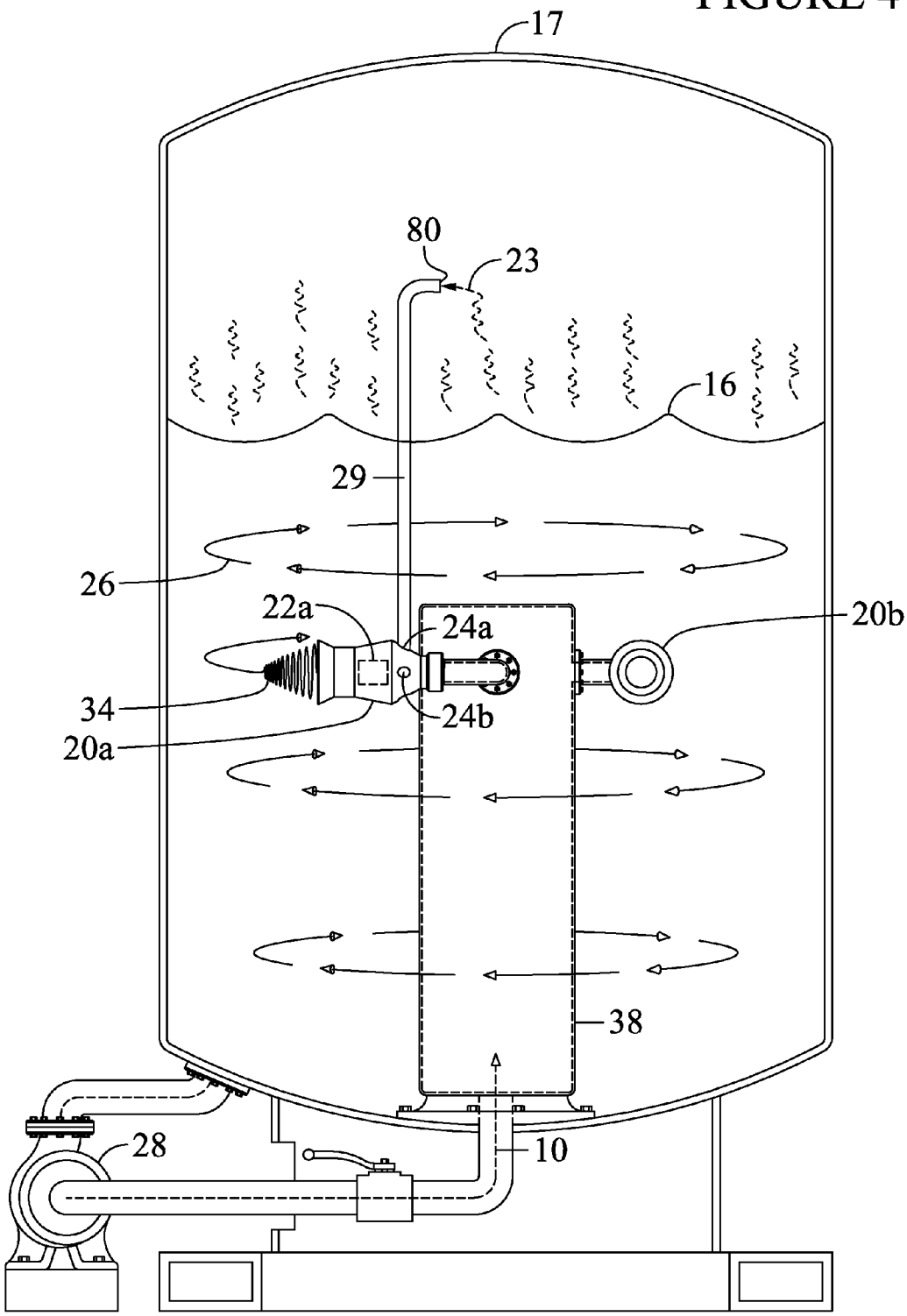
FIG. 4 depicts an alternate apparatus usable to perform the present method.

FIG. 4 depicts the an apparatus usable in the present method, wherein a vapor pipe 29 captures a vapor 23 that rises from the static fluid 16 within the tank 17 during use of the apparatus.

The vapor pipe 29 can be in fluid communication with one of the at least two induction ports 24*a* and 24*b*, so that the vapor 23 can be further mixed within the mixing chamber 22*a*. The vapor pipe has a vapor pipe opening 80 for capturing the vapor 23.

It can be contemplated that the vapor pipe 29 is usable in other embodiments of apparatus which are usable in the present method, or that no vapor pipe 29 be used at all.

Figure 5:
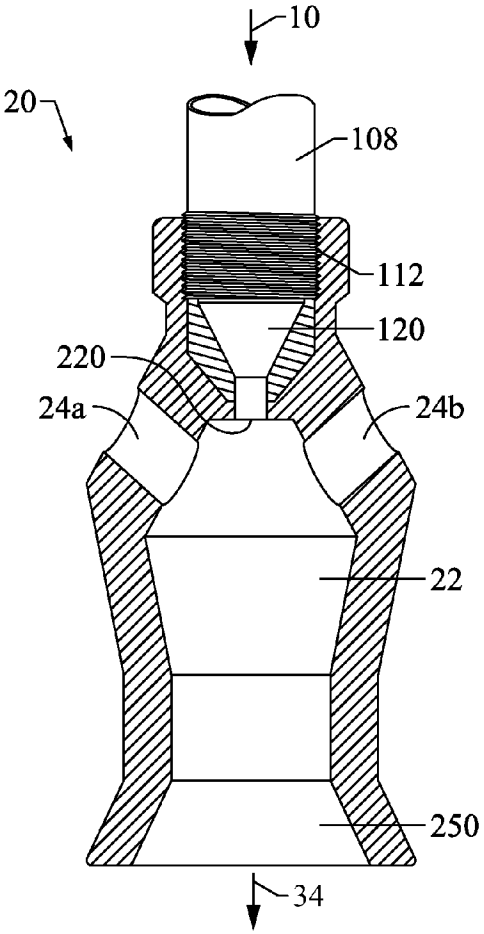
FIG. 5 is a cross sectional view of a radial eductor usable in the present method.

FIG. 5 is a cross sectional view of a radial eductor 20 usable in the present methods.

The radial eductor 20 has least two induction ports 24*a* and 24*b*. The motive fluid stream 10 is introduced into a nozzle 120 of the radial eductor 20. The nozzle 120 can be secured with threads 112 that engage a pipe 108 that attaches to the manifold 38. The motive fluid stream 10 has a first rate of flow as it flows into the radial eductor 20.

The velocity of the motive fluid stream 10 is increased as it passes through orifice 220. The motive fluid stream 10 then mixes within a mixing chamber with components that are introduced into the mixing chamber 22 through the induction ports 24*a* and 24*b*, thereby creating a high pressure mixture 34. The high pressure mixture 34 is expelled through the diverging walls of the diffuser 250, thereby creating a low pressure region proximate the radial eductor 20 within the static fluid 16.

Figure 6:
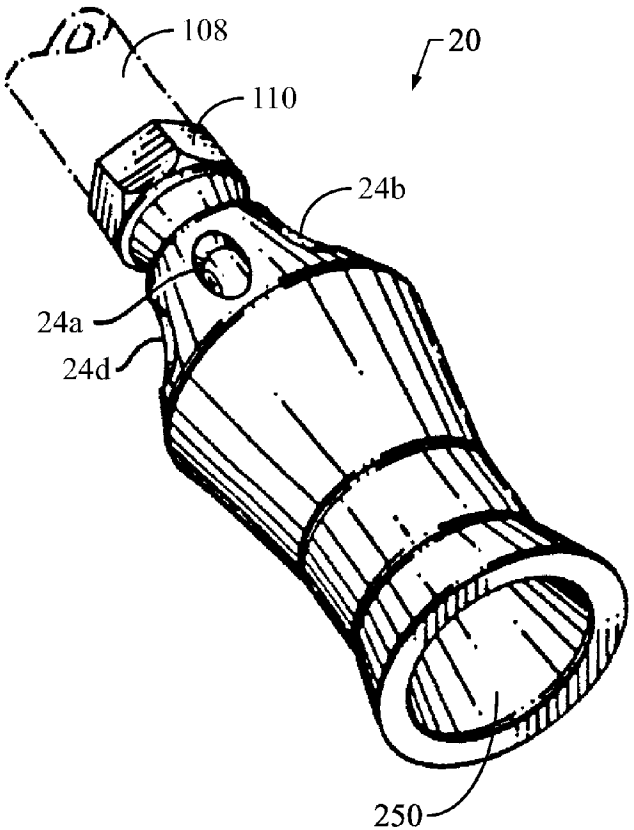
FIG. 6 is a perspective view of the radial educator of FIG. 5.

FIG. 6 shows a perspective view of a radial eductor 20 usable in the present method. A coupler 110 is shown engaging the pipe 108. The coupler 110 can be a flange or some other means of connecting the nozzle to the radial eductor. Diffuser 250 and induction ports 24*a* and 24*b* are also depicted. A third induction port 24*d* is also depicted.

Figure 7:
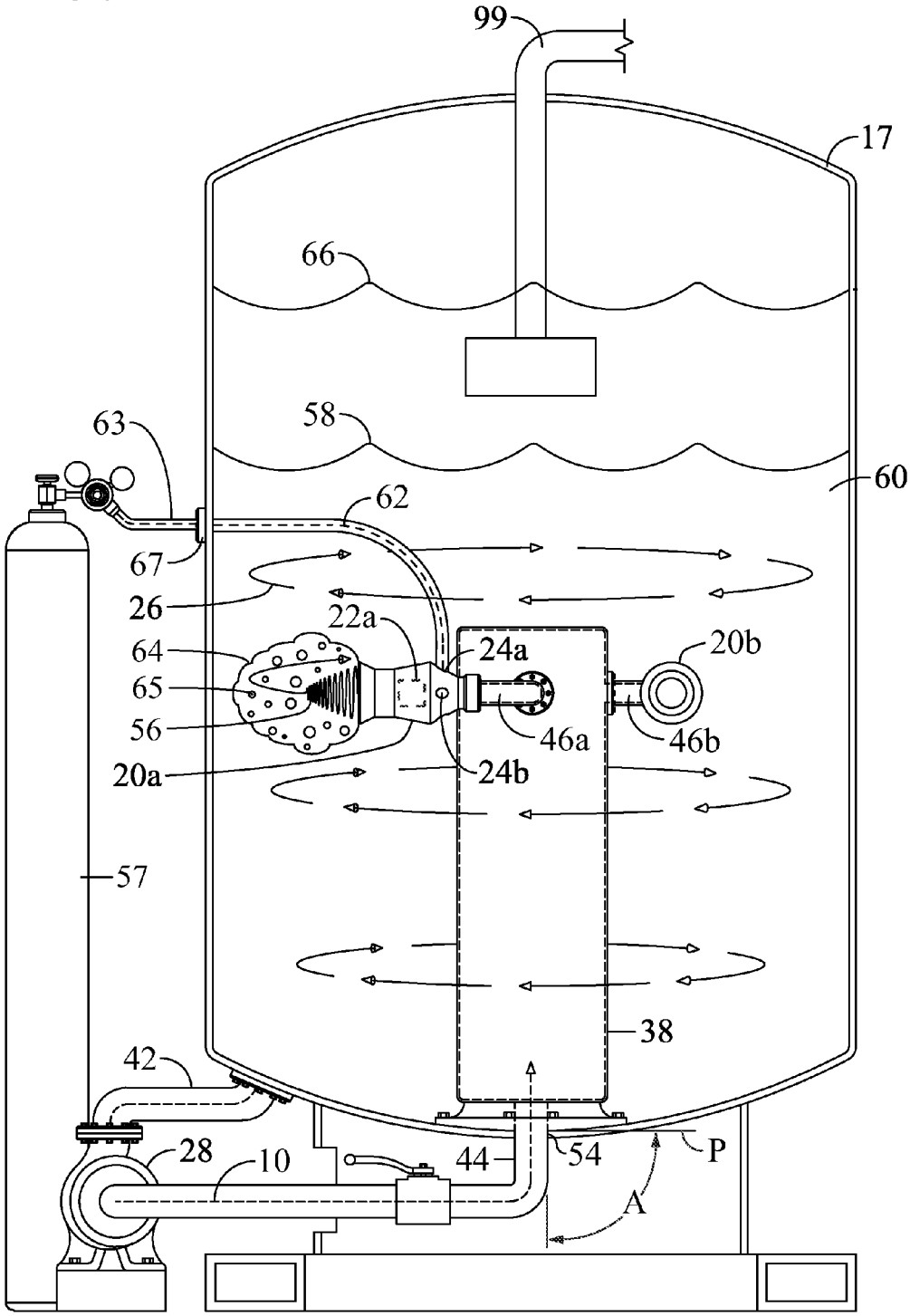
FIG. 7 is an embodiment of an apparatus usable with the present method to perform separation of an oil and water mixture.

FIG. 7 depicts an embodiment of an apparatus usable in the present method for the separation of an oil and water mixture 60. The oil and water mixture 60 is depicted within a tank 17 at a level that completely covers a plurality of radial eductors 20*a* and 20*b* that are disposed within the tank 17, and has a liquid surface 58.

The plurality of radial eductors 20*a* and 20*b* are disposed in fluid communication with a manifold 38, through a plurality of secondary conduits 46*a* and 46*b*. The manifold 38, which is disposed within the tank 17, is in fluid communication with an external energy source 28 through central conduit 44. Central conduit 44 passes into the tank 17 through bottom port 54.

The external energy source 28 is in fluid communication with a motive fluid stream pipe 42, which is in fluid communication with the tank 17. The external energy source 28 draws in the oil and water mixture 60 through the motive fluid stream pipe 42 and pressurizes the oil and water mixture 60, thereby forming a motive fluid stream 10. The motive fluid stream 10 flows from the external energy source 28, through the central conduit 44, into the manifold 38, through the plurality of secondary conduits 46*a* and 46*b*, and into mixing chambers, here mixing chamber 22*a* is depicted.

Air 62 is introduced into a mixing chamber 22*a* of at least one of the plurality of radial eductors 20*a* and 20*b*. Air 62 first exits the air source 57 and passes through the air pipe 63 which is depicted to be in fluid communication with one of the at least two induction ports 24*a*, however it could be in fluid with any of the at least two induction ports 24*a* and 24*b*. Air pipe 63 passes into the tank 17 at air pipe port 67.

The motive fluid stream 10 is pressurized and has a first flow rate as it passes into the mixing chambers by use of the external energy source 28. A low pressure oil and water mixture 56 is then formed proximate the plurality of radial eductors 20*a* and 20*b* when the motive fluid stream 10 is expelled from the plurality of radial eductors 20*a* and 20*b*.

A high pressure mixture 64 with entrained air bubbles 65 is depicted. The high pressure mixture 64 with entrained air bubbles 65 is formed by drawing the low pressure oil and water mixture 56 into the plurality of radial eductors 20*a* and 20*b* through one of the at least two induction ports 24*a* and 24*b*, aspirating or pressurizing the air 62 through one of the at least two induction ports 24*a* and 24*b*, and mixing the air 62 with the low pressure oil and water mixture 56 within the mixing chambers 22, thereby allowing the oil 66 to attach to the entrained air bubbles 65 and rise to the liquid surface 58.

A continuous turbulence 26 is depicted, which is formed in the oil and water mixture 60 by the plurality of radial eductors 20*a* and 20*b*.

The oil 66 is depicted disposed above the liquid surface 58 in the tank 17, allowing the oil to be removed through a vent pipe 99.

It can be noted that the air source 57, along with the air pipe 63, the air pipe port 67, and the air 62, can be used in various embodiments of the present method and is not limited to the present embodiment depicted in FIG. 7.

The central conduit 44 is depicted secured to the tank at an angle "A", which is between 80 and 100 degrees, from a first plane "P" of the tank 17.

Throughout the process, the contents of the tank 17 can continuously flow into the external energy source 28 through the motive fluid stream pipe 42 and back into the tank 17 as described above, thereby creating a continuous and thorough mixing and separation of the contents of the tank 17.

Figure 8:
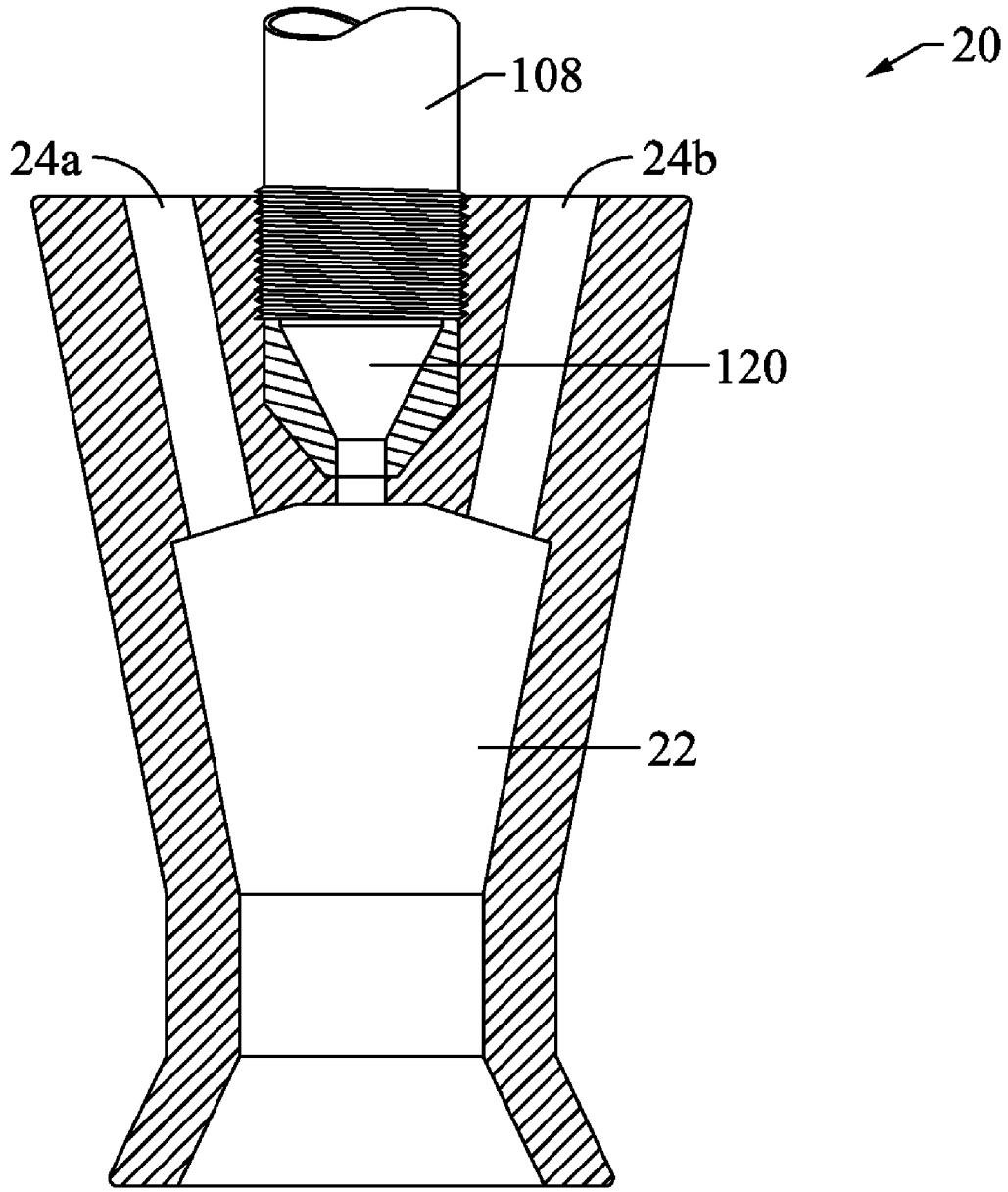
FIG. 8 depicts an alternate radial eductor usable in the present method.

FIG. 8 depicts an alternate radial eductor 20 usable in the present method. FIG. 8 depicts the mixing chamber 22, the pipe 108, and the nozzle 120. FIG. 8 further depicts the at least two induction ports 24*a* and 24*b* disposed on the eductor proximate the pipe 108.

The radial eductor 20 depicted in FIG. 8 has induction ports 24*a* and 24*b* which are disposed substantially parallel to the nozzle 120 and the pipe 108.

While these embodiments have been described with emphasis on the embodiments, it should be understood that within the scope of the appended claims, the embodiments might be practiced other than as specifically described herein.

What is claimed is:

1. A method for mixing a static fluid with a particulate material, a liquid, a compressible fluid or gas, or combinations thereof, to form a uniform mixture, using a motive fluid stream, wherein the method comprises:

positioning a plurality of radial eductors into a tank, each of the plurality of radial eductors having a mixing chamber and at least two induction ports, wherein each of the plurality of radial eductors is adapted for simultaneous pressurization within the tank, and wherein the plurality of radial eductors are positioned to create a continuous turbulence within the tank;

flowing the static fluid into the tank until the static fluid completely covers the plurality of radial eductors;

flowing the static fluid into an external energy source that is in fluid communication with the tank, pressurizing the static fluid with the external energy source, thereby forming the motive fluid stream;

using the external energy source to flow the motive fluid stream from the external energy source and into each of the plurality of radial eductors, wherein the motive fluid stream has a first flow rate as it flows into each of the plurality of radial eductors, thereby simultaneously pressurizing the plurality of radial eductors;

flowing the particulate material, the liquid, the compressible fluid or gas, or combinations thereof, through at least one of the at least two induction ports into the mixing chamber of at least one of the plurality of radial eductors;

blending the motive fluid stream with the particulate material, the liquid, the compressible fluid or gas, or combinations thereof, thereby forming a high pressure mixture;

expelling the high pressure mixture from each of the plurality of radial eductors and into the static fluid, thereby generating a mixed fluid in a low pressure region proximate to each of the plurality of radial eductors, wherein the mixed fluid comprises the static fluid mixed with the high pressure mixture;

drawing the mixed fluid through at least one of the at least two induction ports and into the mixing chambers of each of the plurality of radial eductors at a second flow rate; and continuously mixing the mixed fluid within the mixing chamber, continuously expelling the mixed fluid into the tank with the static fluid, and continuously drawing the mixed fluid through at least one of the at least two induction ports and into the mixing chambers, thereby forming the uniform mixture.

2. The method of claim 1, wherein the second flow rate is no less than three times the first flow rate.

3. The method of claim 1, wherein the static fluid is continuously drawn into the external energy source through a motive fluid stream pipe that is in fluid communication with both the tank and the external energy source, and wherein the static fluid is continuously pressurized by the external energy source, thereby forming a continuous motive fluid stream.

4. The method of claim 1, wherein the static fluid is a member of the group consisting of: a liquid; a slurry; a slurry with suspended solids; an admixture; two or more unblended fluids; a drilling fluid; an industrial mixture; municipal waste; a drilling mud; an oil and water mixture; a solution; or combinations thereof.

5. The method of claim 1, wherein the tank has a shape that is a member of the group consisting of: rectangular; circular; polygonal, cylindrical, and square.

6. The method of claim 1, wherein each of the plurality of radial eductors is oriented to facilitate continuous mixing within the tank.

7. The method of claim 1, further comprising connecting the plurality of radial eductors together using a manifold, wherein the manifold is in fluid communication with the external energy source; and using the external energy source to flow the motive fluid stream into the manifold, wherein the manifold flows the motive fluid stream into the plurality of radial eductors.

8. The method of claim 7, further comprising the step of securing the manifold to a bottom of the tank.

9. The method of claim 7, wherein the manifold has a central conduit and a plurality of secondary conduits connected to the central conduit, wherein each of the plurality radial eductors is in fluid communication with one of the plurality of secondary conduits and the central conduit is in fluid communication with the external energy source.

10. The method of claim 9 wherein the central conduit is secured to the tank at an angle between 80 and 100 degrees from a first plane of the tank, and wherein the central conduit is in fluid communication with the external energy source through a side port disposed on a side of the tank, a top port disposed on a top of the tank, or a bottom port disposed on a bottom of the tank.

11. The method of claim 1, further comprising using the motive fluid stream at a pressure between 30 psi to 150 psi.

12. The method of claim 1, wherein the particulate material and the liquid, when mixed, have a percent of solids of between 25 weight percent to 35 weight percent, and a percent of liquids of between 65 weight percent to 75 weight percent.

13. The method of claim 1, wherein the uniform mixture has a viscosity ranging between the viscosity of water and the viscosity of slurries of up to twelve hundred centipoises.

14. The method of claim 1, wherein the at least two induction ports are helically shaped.

15. The method of claim 1, wherein the external energy source is a member of the group consisting of: a centrifugal pump; a progressive cavity pump; and a rotary pump.

16. The method of claim 1 further comprising, a vapor pipe with a vapor pipe opening, wherein the vapor pipe is in fluid communication with at least one of the at least two induction ports, for capturing vapor and introducing the vapor into each mixing chamber of each of the plurality of radial eductors.

17. The method of claim 1 further comprising, a vent pipe disposed proximate a top of the tank, for venting gases and vapor from within the tank.

18. The method of claim 1 wherein each of the plurality of radial eductors further comprise a nozzle disposed within each of the plurality of radial eductors, wherein the motive fluid stream passes through the nozzle as it enters the mixing chamber, for pressurizing the motive fluid stream.

19. The method of claim 18, wherein the nozzle has a lobestar orifice disposed within the nozzle.

* * * * *